United States Patent [19]

Weber

[11] Patent Number: 4,548,139

[45] Date of Patent: Oct. 22, 1985

[54] GRATE FOR INDUSTRIAL FURNACES

[75] Inventor: Erich Weber, Munich, Fed. Rep. of Germany

[73] Assignee: Martin GmbH fur Umwelt- und Energietechnik, Munich, Fed. Rep. of Germany

[21] Appl. No.: 643,283

[22] Filed: Aug. 22, 1984

[30] Foreign Application Priority Data

Aug. 24, 1983 [DE] Fed. Rep. of Germany ..... 3330636

[51] Int. Cl.[4] ..... F23H 17/00

[52] U.S. Cl. ..... 110/328; 110/281; 126/167; 126/175

[58] Field of Search ..... 110/267, 268, 271, 278, 110/281, 282, 286, 291, 327, 328; 126/152 R, 152 B, 167, 174, 175

[56] References Cited

U.S. PATENT DOCUMENTS

| | | | |
|---|---|---|---|
| 2,263,403 | 11/1941 | Stone | 110/268 |
| 3,563,190 | 2/1971 | Sprague et al. | 110/328 |
| 4,018,168 | 4/1977 | Andreoli et al. | 110/268 |
| 4,096,809 | 6/1978 | Martin et al. | 110/271 |
| 4,103,627 | 8/1978 | Mainka | 110/281 |
| 4,235,172 | 11/1980 | Martin et al. | 110/281 |
| 4,239,029 | 12/1980 | Martin et al. | 110/281 |
| 4,240,402 | 12/1980 | Martin et al. | 110/268 |
| 4,450,952 | 5/1984 | Steiner | 126/175 |
| 4,463,688 | 8/1984 | Andreoli | 110/278 |

*Primary Examiner*—Albert J. Makay
*Assistant Examiner*—Steven E. Warner
*Attorney, Agent, or Firm*—Peter K. Kontler

[57] ABSTRACT

A grate for industrial furnaces wherein pairs of stationary grate bars flank movable grate bars. The grate bars of each pair are connected to each other by an elongated coupling device which extends through one or more elongated slots of the movable grate bar between them. The coupling device has two bolts whose heads are pivotably anchored in the downwardly extending ribs of the stationary bars and an internally threaded sleeve which is located between the slots in two downwardly extending ribs of the movable grate bar and meshes with the shanks of the two bolts. The shanks have oppositely inclined threads and the sleeve is held in the selected position by a lock nut. The ribs at the undersides of the two stationary bars have vertically extending slots which are open at the lower ends to allow for introduction of the shanks of the respective bolts, and the upper ends of the slots are enlarged to take portions of the heads of the bolts and to thus prevent rotation of bolts relative to the respective grate bars.

11 Claims, 3 Drawing Figures

GRATE FOR INDUSTRIAL FURNACES

BACKGROUND OF THE INVENTION

The present invention relates to industrial furnaces in general, and more particularly to improvements in grates which can be used in such types of furnaces. Still more particularly, the invention relates to improvements in grates of the type wherein mobile grate bars alternate with stationary grate bars and the mobile grate bars are coupled to but can be displaced relative to the adjacent stationary grate bars.

Grates of the above outlined character are equipped with means for moving the mobile grate bars relative to the stationary grate bars. Reference may be had to U.S. Pat. No. 4,239,029 wherein FIG. 2 shows a portion of a grate with mechanically movable bars. The ribs at the underside of the mobile grate bar which is shown in FIG. 2 are provided with elongated slots for portions of a coupling device which secures the neighboring stationary grate bars to each other but enables the mobile grate bar between the stationary bars to perform requisite movements with reference thereto. The coupling device is a one-piece body having an elongated central portion or stem extending through the slots of ribs at the underside of the mobile bar and two enlarged end portions which abut against the adjacent surfaces of ribs at the undersides of the neighboring stationary bars and hold such stationary bars against movement away from each other, i.e., away from the respective sides of the mobile bar. The end portions of the coupling device have flat surfaces which are in full contact with the adjacent surfaces of the corresponding stationary bars. A drawback of this coupling device is that it is likely to jam and to thus prevent the mobile bar from moving forwardly and backwards with reference to the stationary bars. Moreover, particles of partially combusted solid fuel and/or cinder which penetrate between the stationary and mobile grate bars invariably tend to subject the coupling device to eccentric forces which entail a flexing of the coupling device and even permanent bending which evidently interferes with predictable movements of the mobile grate bar relative to the neighboring stationary bars.

Another drawback of the just discussed conventional coupling device is that it cannot be adequately adjusted to compensate for progressing wear upon the grate bars. The wear is quite extensive and, therefore, the distance between the stationary grate bars which flank the mobile bar will increase considerably as the wear progresses. Adjustability is further desirable on the grond that, when one or more grate bars require a secondary treatment after a certain period of use, such secondary treatment normally entails removal of at least some material with resulting further increase in tolerances which cannot be compensated for by the just described conventional coupling device. As a rule, wear is compensated for by removing a previously employed coupling device and replacing it with a fresh coupling device.

FIG. 4 of the aforementioned patent discloses a screw which is provided to facilitate adjustment of the coupling device relative to the grate bars in order to compensate for wear and manufacturing tolerances. Such one-sided adjustment is unsatisfactory and insufficient when the wear is pronounced and/or upon completion of secondary treatment of one or more grate bars. Still further, the single screw tends to urge the other end portion of the coupling device flush against the adjacent surface of the corresponding stationary grate bar.

FIG. 8 of the aforementioned patent discloses a coupling device with two transversely extending screws. A drawback of such proposal is that the extent of adjustability is minimal and also that the two screws must be carefully adjusted to the same extent in order to ensure balanced distribution of stresses. Also, the screws tend to become loose when the grate is in use so that the reliability of the coupling device is questionable.

A drawback which is common to all embodiments of the patented grate is that a defective grate bar can be removed only upon removal or shifting of several coupling devices. This is a time-consuming operation which contributes significantly to the down times of the grate and of the entire furnace.

OBJECTS AND SUMMARY OF THE INVENTION

An object of the invention is to provide a novel and improved grate for use in industrial furnaces or the like wherein the stationary and mobile grate bars are coupled to each other in a novel and improved way.

Another object of the invention is to provide a novel and improved coupling device which can be used in a grate of the above outlined character.

A further object of the invention is to provide novel and improved grate bars which can be used in the above outlined grate in conjunction with the improved coupling device.

An additional object of the invention is to provide a novel and improved method of reducing the likelihood of flexing or bending of coupling devices which secure stationary and mobile grate bars of a grate to each other.

Still another object of the invention is to provide a grate wherein the wear upon the grate bars and/or the fact that some material is removed from the grate bars during secondary treatment can be compensated for within any desired practical range in a simple and time-saving operation.

An additional object of the invention is to provide a grate wherein the removal of a selected grate bar does not necessitate removal or other manipulation of several grate bars and/or coupling devices.

A further object of the invention is to provide a coupling device which is constructed, assembled and mounted in a grate for industrial furnaces or the like in such a way that it is subjected to negligible bending stresses or to no bending stresses at all.

Another object of the invention is to provide a grate wherein the coupling devices between the stationary and mobile grate bars can stand longer periods of use than in heretofore known grates and wherein the coupling devices are more versatile than the presently known coupling devices.

The invention is embodied in a grate for an industrial furnace or the like. The grate comprises spaced apart elongated first and second stationary grate bars, a third grate bar which is disposed between and is movable forwardly and backwards with reference to the first and second grate bars, and means for securing the first and second grate bars to each other so as to prevent them from moving apart, i.e., laterally and away from the respective sides of the third grate bar. The securing means comprises an elongated coupling device which extends transversely of the grate bars and has discrete first and second components (preferably in the form of bolts each having an externally threaded portion or shank and a head) which are respectively anchored in the first and second grate bars and a third component which separably connects the first and second components to each other. The third grate bar has an opening (e.g., in the form of an elongated slot) through which the coupling device extends and which is sufficiently large to allow the third grate bar to move with reference to the first and second bars.

The first and second grate bars have longitudinally extending surfaces which face away from each other and from the third grate bar, and the first and second components have convex surfaces which abut against the surfaces of the respective (first and second) grate bars. Such convex surfaces can be provided on the heads of the aforementioned bolts. The third component can constitute or include an internally threaded sleeve which meshes with the shanks of the two bolts and is disposed between the openings of the third grate bar. The threads of the shanks of the two bolts are inclined in opposite directions. The radii of curvature of the aforementioned convex surfaces are preferably located in a plane which includes the common axis of the shanks and of the internally threaded sleeve. The first and second components are preferably mirror symmetrical to each other with reference to a plane which is normal to the common axis and is located between the first and second components. The spherical or convex surfaces are preferably provided on selected portions of the heads of the aforementioned bolts, namely on portions which extend laterally beyond the respective shanks.

The first and second grate bars are preferably provided with slotted portions which are adjacent to the third grate bar and serve to hold the respective bolts from moving toward each other. The shanks of the respective bolts extend through the corresponding slots and toward the third grate bar, i.e., into mesh with the sleeve. The just mentioned portions or ribs of the first and second grate bars preferably comprise means for holding the corresponding components (bolts) against rotation. This can be achieved by enlarging the upper end portions of the slots in the ribs so that the enlarged portions of the slots constitute sockets which receive portions of the respective heads.

The novel features which are considered as characteristic of the invention are set forth in particular in the appended claims. The improved grate itself, however, both as to its construction and the mode of assembling the same, together with additional features and advantages thereof, will be best understood upon perusal of the following detailed description of certain specific embodiments with reference to the accompanying drawing.

DESCRIPTION OF THE PREFERRED EMBODIMENTS

Figure 1:
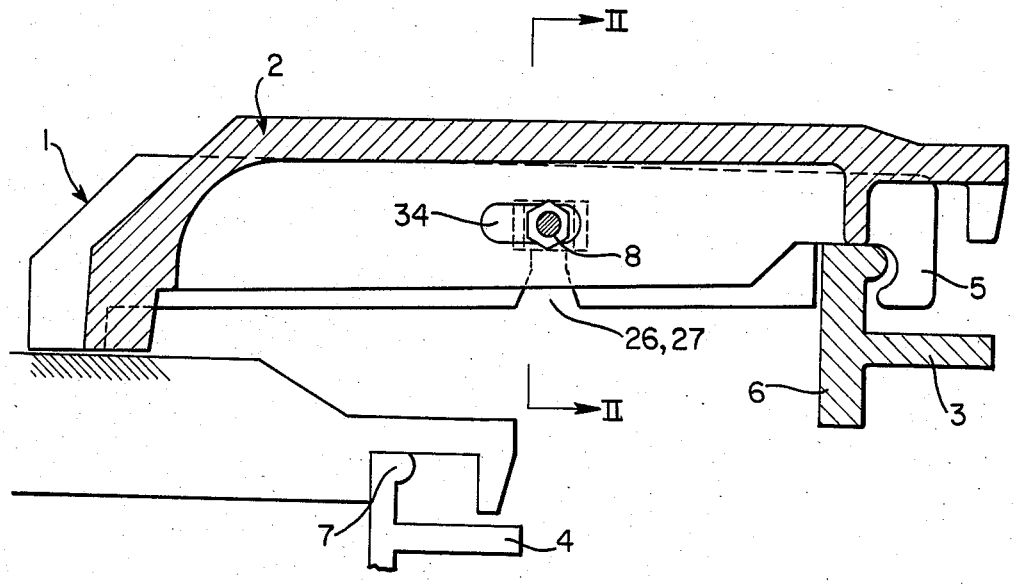
FIG. 1 is a fragmentary longitudinal sectional view through a grate which embodies the invention.

Referring first to FIG. 1, there is shown a portion of a stepped grate for use in industrial furnaces or the like. Each step or stage comprises a pair of grate bars 1 which flank a forwardly and rearwardly movable grate bar 2. If the entire grate is movable, the grate bars 1 and 2 are mounted on shiftable frame members 3. If the grate bars 1 are stationary, the grate bars are mounted on or in a stationary frame member 4. The bars 1 are attached to the frame member 3 substantially without longitudinal play; for this purpose, their downwardly extending portions 5 are suitably configurated to engage the underside of the rail 6 on the frame member 3. The mobile grate bar 2 is movable forwardly and rearwardly with reference to the bars 1 which are coupled to the rail 6. The frame member 4 has an analogous rail 7 for the grate bars 1.

Figure 2:
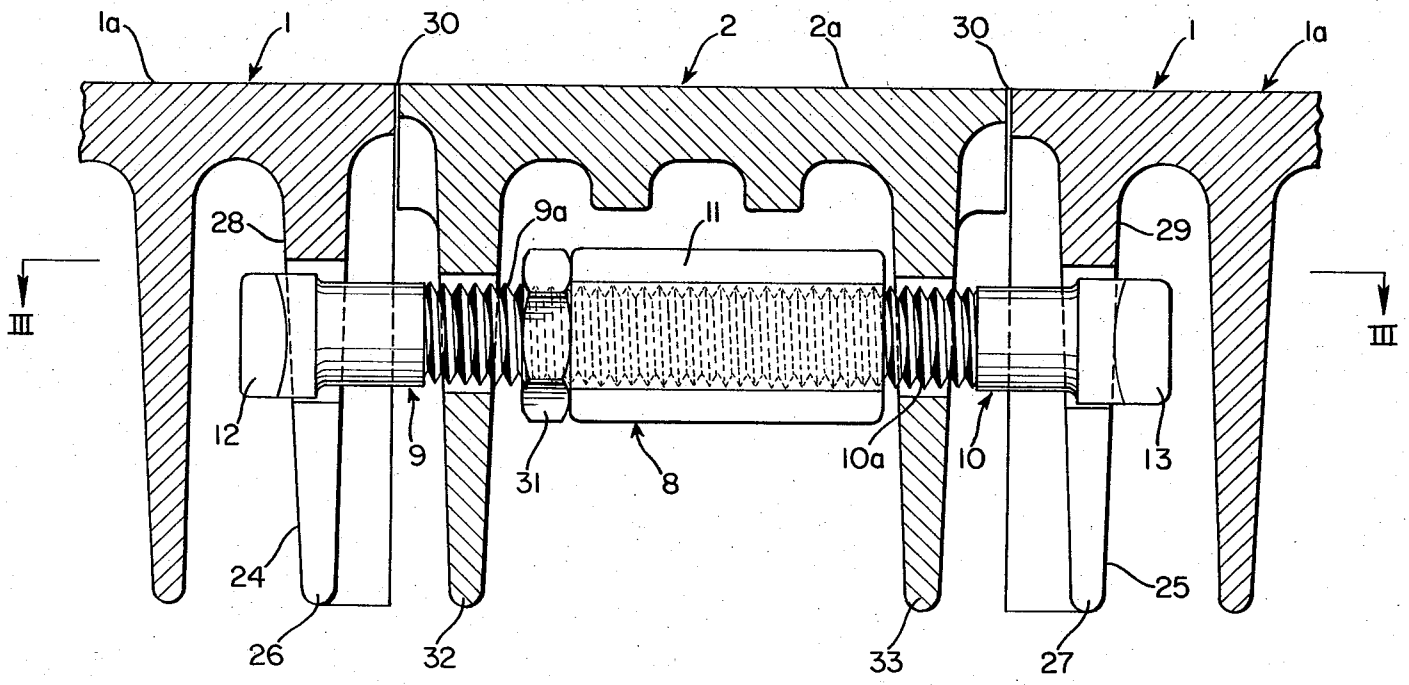
FIG. 2 is an enlarged transverse vertical sectional view as seen in the direction of arrows from the line II—II of FIG. 1.
Figure 3:
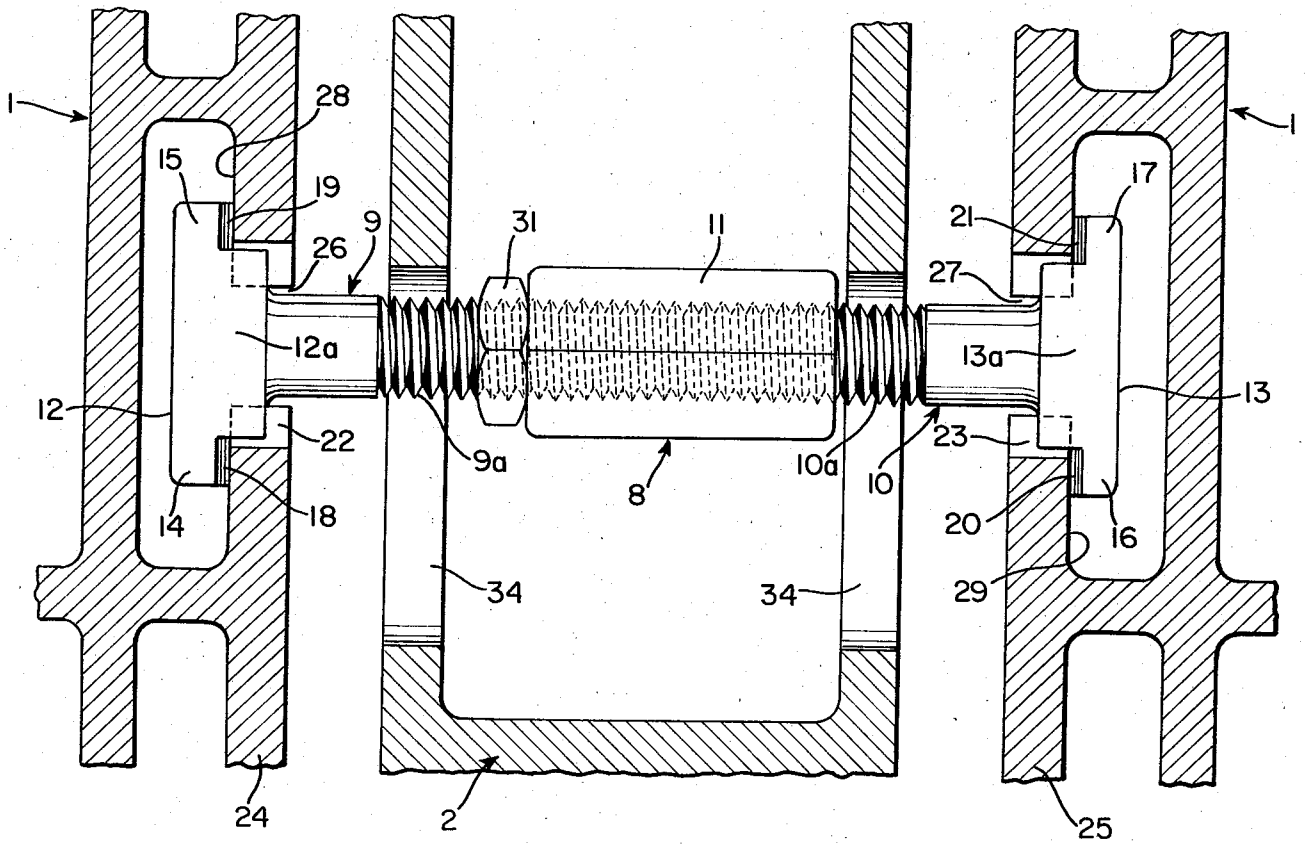
FIG. 3 is a horizontal sectional view as seen in the direction of arrows from the line III—III of FIG. 2.

The two grate bars 1 which are shown in FIGS. 2 and 3 will be called stationary grate bars because they are stationary with reference to the mobile bar 2 therebetween. However, and as explained above, and as also explained in the aforementioned patent (whose disclosure is incorporated herein by reference), the grate bars 1 can also move if they are mounted in the frame member 4 in lieu of the frame member 3. These stationary grate bars 1 flank the mobile grate bar 2 and are secured to each other by a novel and improved coupling device 8 in such a way that the device 8 determines the maximum possible distance between the two grate bars 1. The mobile grate bar 2 is movable not only with reference to the adjacent grate bars 1 but also with reference to the frame member 3 or 4 as well as with reference to the coupling device 8.

The illustrated coupling device 8 comprises two mirror symmetrical first and second components 9, 10 each of which is anchored in one of the stationary grate bars 1, and a centrally located third component 11 which is disposed between two downwardly extending portions or ribs 32, 33 of the grate bar 2 and connects the components 9 and 10 to each other. Each of the components 9, 10 is a bolt having an externally threaded shank *9a*, *10a* which extends from the respective grate bar 1 and through and beyond an elongated closed slot-shaped opening 34 in the respective rib 32 or 33 of the bar 2. The threads of the shanks *9a* and *10a* are inclined in opposite directions and the third component 11 is an internally threaded sleeve which meshes with the shanks *9a*, *10a* and is rotatable clockwise or counterclockwise in order to increase or reduce the distance between the heads 12, 13 of the bolts 9, 10. A lock nut 31 is preferably provided to fix the sleeve 11 in the selected axial position and to thus ensure that the distance between the two stationary grate bars 1 will not increase beyond that which is permitted by the heads 12 and 13. The heads 12 and 13 are elongated (see FIG. 3) and portions 14, 15 and 16, 17 thereof extend laterally beyond the respective shanks *9a*, *10a*. Such laterally extending portions 14–17 are formed with convex surfaces 18, 19, 20, 21 abutting against flat surfaces 28, 29 on the ribs 24, 25 of the respective stationary grate bars 1. The surfaces 28, 29 face away from each other and from the mobile grate bar 2 therebetween.

As can be seen in FIG. 2, each of the grate bars 1 and 2 has a top section *1a*, *2a* which supports the fuel in a furnace and a second section including several ribs. The grate bar 2 has the aforementioned ribs 32 and 33, and the grate bars 1 have the ribs 24, 25 which are respectively provided with upwardly extending elongated slots 26, 27 having enlarged upper end portions or sockets 22, 23 for the respective heads 12, 13. The surfaces bounding the sockets 22 and 23 prevent rotation of the respective bolts 9 and 10 about the common axis of their externally threaded shanks 9*a*, 10*a* and the sleeve 11. To this end, each of the heads 12, 13 has an extension 12*a*, 13*a* which extends into and cannot rotate in the respective socket 22, 23. The bolts 9 and 10 can be detached from the respective grate bars 1 in response to rotation of the sleeve 11 in a direction to increase the distance between the heads 12, 13 so that the extensions 12*a*, 13*a* of such heads move out of the respective sockets 22, 23. In the next step, the shanks 9*a*, 10*a* of the bolts 9 and 10 can be caused to slide downwardly, as viewed in FIG. 2, and through and beyond the open lower ends of the respective slots 26, 27.

An advantage of the convex surfaces 18 to 21 is that, when a piece of solid material (e.g., a piece of coal or cinder) penetrates into one of the gaps 30 between the grate bars 1 and 2, the grate bars 1 and 2 can swivel relative to each other so that the composite coupling device 8 is subjected exclusively, or practically exclusively, to axial stresses. Therefore, the likelihood of bending the coupling device 8 is minimal.

While it is also possible to have the external threads on the shanks 9*a*, 10*a* of the bolts 9, 10 inclined in the same direction, the provision of threads which are inclined in opposite directions is preferred at this time because it allows for more rapid movement of the bolts 9, 10 toward or away from each other when the lock nut 31 is loosened and the sleeve 11 is rotated in a clockwise or counterclockwise direction. Moreover, the distribution of stresses is more uniform if the threads are inclined in opposite directions.

As can be seen in FIG. 3, the length of openings 34 in the ribs 32, 33 of the lower section of the grate bar 2 determines the extent to which this grate bar is movable forwardly and backwards with reference to the grate bars 1 and coupling device 8.

In order to assemble the grate bar 2 with the adjoining grate bars 1, the coupling device 8 is first connected to the mobile grate bar 2, i.e., the sleeve 11 is placed into the space between the ribs 32, 33 and the shanks 9*a* and 10*a* of the bolts 9 and 10 are caused to mesh with the respective end portions of the sleeve 11 by extending through the corresponding slots 34 in the adjacent ribs 32, 33. The distance between the heads 12, 13 of the bolts 9 and 10 (subsequent to connection of such bolts with the sleeve 11) is such that the grate bars 1 can be moved downwardly along the respective sides of the grate bar 2 whereby the shanks 9*a*, 10*a* of the bolts 9, 10 enter the open lower ends of the respective slots 26, 27 and the slots continue to move downwardly until the sockets 22, 23 are in line with the respective heads 12 and 13. The sleeve 11 is thereupon rotated again to move the heads 12, 13 toward each other and to cause entry of the extensions 12*a*, 13*a* of such heads into the respective sockets 22 and 23. The convex surfaces 18, 19 and 20, 21 respectively abut against and can roll along the adjacent surfaces 28, 29 and/or vice versa. Rotation of the sleeve 11 is terminated when the width of the gaps 30 is reduced to the desired value. In the last step, the lock nut 31 is applied to hold the sleeve 11 in the selected position, i.e., to ensure that the length of the coupling device 8 does not change when the grate is in actual use.

In order to remove a grate bar 1 or 2, the operator first loosens the lock nut 31 and thereupon rotates the sleeve 11 so as to expel the extensions 12*a*, 13*a* of the heads 12, 13 from the respective sockets 22 and 23. This renders it possible to lift either of the grate bars 1 above and away from the mobile grate bar 2. In order to remove the grate bar 2, the grate bars 1 are lifted to an extent which is necessary to move the open lower ends of the slots 26, 27 above the shanks 9*a*, 10*a* of the respective bolts 9, 10. This releases the grate bar 2 for movement away from the remainder of the grate, together with the coupling device 8.

The extent to which the coupling device 8 can compensate for wear upon the neighboring surfaces of the grate bars 1 and 2 depends solely upon the distance between the ribs 32, 33 of the grate bar 2. As can be seen in FIG. 2, this provides ample room for adjustments within a very wide range.

An important advantage of the improved coupling device 8 is that it is very simple to change its length and hence the maximum distance between the grate bars 1. Moreover, the adjustments can be carried out within a very wide range so that the grate bars need not be replaced at frequent intervals but can be used much longer than in grates which employ conventional coupling devices. Still further, the removal of a defective grate bar or the insertion of a repaired or fresh grate bar is surprisingly simple and takes up a short interval of time. Moreover, and as fully explained above, the spherical or convex surfaces 18–21 of the heads 12 and 13 ensure that the coupling device 8 is not subjected to any, or is subjected to negligible, bending or flexing stresses. This contributes significantly to longer useful life of the coupling device and reduces the down times of the furnace which employs the improved grate.

An additional advantage of the coupling device 8 is that the distance between the heads 12, 13 of the bolts 9, 10 can be increased or reduced within a wide range and within a short interval of time, i.e., by the simple expedient of rotating the sleeve 11 in a clockwise or in a counterclockwise direction. The movements of the bolts 9, 10 are identical due to their mirror symmetrical arrangement and due to the fact that the threads of their shanks 9*a*, 10*a* are inclined in opposite directions. Such construction of the coupling device 8 simplifies the task of assembling the grate bars 1 and 2 as well as the task of assembling the grate bars in a predictable and reproducible fashion.

The provision of convex surfaces 18 to 21 on the laterally extending portions 14 to 17 of the respective heads 12 and 13 also contributes to the longer useful life of the coupling device 8 and of the entire grate. Thus, the convex surfaces are distributed symmetrically with reference to the common axis of the bolts 9, 10 and sleeve 11 to thereby further reduce the likelihood of the development of bending or flexing stresses when the grate is in actual use. Moreover, such configuration of the heads 12, 13 further reduces the likelihood of rotation of the bolts 9, 10 relative to the sleeve 11 and/or vice versa. However, the major part of the task of preventing undesirable rotation of the bolts 9, 10 relative to the corresponding grate bars 1 is performed by the extensions 12*a*, 13*a* in the respective sockets or enlarged portions 22, 23 of the slots 26 and 27.

The sockets 22, 23 and the extensions 12*a*, 13*a* perform an additional desirable function, namely that of preventing a tilting of the coupling device 8 as a result of movement of the bolt 9 to a level below the level of the bolt 10 or vice versa. Thus, once the extensions 12*a*, 13*a* are caused to enter the respective sockets 22, 23, the coupling device 8 and its bolts 9, 10 are held against sliding in the respective slots 26, 27 so that the axis of the device 8 remains parallel to the plane of the upper side of the mobile grate bar 2 and of the upper sides of the grate bars 1.

An important advantage of the slots 26, 27 which are open at their lower ends is that they allow for very simple and rapid removal or attachment of a grate bar 1 or 2. As explained above, all that is necessary is to rotate the sleeve 11 in a direction to expel the extensions 12*a*, 13*a* from the sockets 22, 23 so that the grate bars 1 can be lifted relative to the grate bar 2, either for the purpose of removing them from the grate or for permitting removal of the grate bar 2 as soon as the slots 26, 27 are lifted above the coupling device 8.

Grates which can use the coupling device and the grate bars of the present invention are further disclosed in U.S. Pat. No. 4,240,402, in U.S. Pat. No. 4,096,809 and in U.S. Pat. No. 4,235,172.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. In a grate for an industrial furnace or the like, the combination of spaced apart elongated first and second grate bars; a third elongated grate bar disposed between and movable relative to said first and second bars; and means for securing said first and second bars to each other, including an elongated coupling device extending transversely of said bars and having discrete first and second components respectively anchored in said first and second bars and a third component separably connecting said first and second components to each other, said first and second components having coaxial first and second threaded portions and said third component having a third threaded portion coaxial to and mating with said first and second threaded portions, said third bar having at least one opening through which said device extends and which is sufficiently large to allow said third bar to move with respect to said first and second bars.

2. The combination of claim 1, wherein said first and second bars have surfaces facing away from said third bar and said first and second components have convex surfaces abutting against said surfaces of the first and second bars, respectively.

3. The combination of claim 1, wherein each of said first and second components includes a bolt having an externally threaded shank and said third component includes an internally threaded sleeve meshing with said shanks, the threads of said shanks being inclined in opposite directions.

4. The combination of claim 3, wherein said bolts have heads provided with convex surfaces, said first and second bars having surfaces facing away from said third bar and abutting against the convex surfaces of the heads of said first and second components, respectively.

5. The combination of claim 1, wherein each of said first and second bars has a slotted portion adjacent to said third bar and said first and second components include portions extending through the slots of said portions of the first and second bars, respectively.

6. The combination of claim 5, wherein said portions of said first and second bars have means for respectively holding the first and second components against rotation in the first and second bars.

7. The combination of claim 6, wherein each of said first and second bars has a top section and a bottom section including the slotted portion of the respective bar, the slots of said portions of said first and second bars having open lower ends for introduction of the first and second components, respectively, and enlarged portions remote from the open lower ends for non-rotatably receiving portions of the first and second components, respectively.

8. The combination of claim 7, wherein said enlarged portions are sockets and said first and second components have threaded portions connected with said third component and heads including portions extending laterially of the threaded portions of the respective components and into the sockets of the slots in the respective bars.

9. In a grate for an industrial furnace or the like, the combination of spaced apart elongated first and second grate bars; a third elongated grate bar disposed between and movable relative to said first and second bars; and means for securing said first and second bars to each other, including an elongated coupling device extending transversely of said bars and having discrete first and second components respectively anchored in said first and second bars and a third component separably connecting said first and second components to each other, said first and second components having first and second threaded portions and said third component having a third threaded portion coaxial to and mating with said first and second threaded portions, said first and second bars having surfaces facing away from said third bar and said first and second components having convex surfaces abutting against said surfaces of the first and second bars, respectively, the radii of curvature of said convex surfaces being located in a plane including the common axis of said threaded portions and said third bar having at least one opening through which said device extends and which is sufficiently large to allow said third bar to move with respect to said first and second bars.

10. The combination of claim 9, wherein said first and second components are mirror symmetrical to each other with reference to a plane which is normal to said axis and is disposed between said first and second components.

11. In a grate for an industrial furnace or the like, the combination of spaced apart elongated first and second grate bars; a third elongated grate bar disposed between and movable relative to said first and second bars; and means for securing said first and second bars to each other, including an elongated coupling device extending transversely of said bars and having discrete first and second components respectively anchored in said first and second bars and a third compenent separably connecting said first and second components to each other, each of said first and second components including a bolt having an externally threaded shank and said third component including an internally threaded sleeve meshing with said shanks, the threads of said shanks being inclined in opposite directions and said bolts further having heads provided with convex surfaces, said first and second bars having surfaces facing away from said third bar and abutting against the convex surfaces of the heads of said first and second components, respectively, said heads having portions extending transversely of and beyond the shanks of the respective bolts and said third bar having at least one opening through which said device extends and which is sufficiently large to allow said third bar to move with respect to said first and second bars.

* * * * *